US005088219A

United States Patent [19]

Toraby-Payhan

[11] Patent Number: 5,088,219

[45] Date of Patent: Feb. 18, 1992

[54] SCROLLING DISPLAY DEVICE

[76] Inventor: Reza Toraby-Payhan, 1889 N. 105th E. Ave., Tulsa, Okla. 74116

[21] Appl. No.: 424,342

[22] Filed: Oct. 19, 1989

[51] Int. Cl.[5] ..... G09F 11/18

[52] U.S. Cl. ..... 40/471; 40/518; 310/77

[58] Field of Search ..... 40/518, 471, 467, 468, 40/469, 970; 310/77, 93

[56] References Cited

U.S. PATENT DOCUMENTS

| | | | |
|---|---|---|---|
| 2,935,806 | 5/1960 | Young . | |
| 3,334,432 | 8/1967 | Bates et al. . | |
| 3,364,604 | 1/1968 | Donaldson et al. | 40/471 |
| 3,631,618 | 1/1972 | Habuka . | |
| 3,726,031 | 4/1973 | Singer . | |
| 3,827,725 | 8/1974 | Fuetsch | 40/471 |
| 3,961,433 | 6/1976 | D'Cruz et al. | 40/471 |
| 4,110,925 | 9/1978 | Strand et al. . | |
| 4,173,087 | 11/1979 | Saylor et al. . | |
| 4,180,933 | 1/1980 | Chammah | 40/471 |
| 4,560,895 | 12/1985 | Zahner | 310/77 |
| 4,680,883 | 7/1987 | Stadjuhar et al. . | |
| 4,707,938 | 11/1987 | Carssow . | |
| 4,741,118 | 5/1988 | Aiken et al. . | |
| 4,773,176 | 9/1988 | Grehan . | |
| 4,798,269 | 1/1989 | Lindner | 310/77 |
| 4,853,573 | 8/1989 | Wilcott et al. | 310/93 |

FOREIGN PATENT DOCUMENTS

| | | | |
|---|---|---|---|
| 1428104 | 3/1976 | United Kingdom | 40/471 |

*Primary Examiner*—Peter H. Brown
*Assistant Examiner*—James M. Gardner
*Attorney, Agent, or Firm*—Head & Johnson

[57] ABSTRACT

A scrolling display device which includes a first roller mechanism and a second roller mechanism opposed to each other with a web display extending between the roller mechanisms. A first motor drivingly engages with the first roller mechanism to rotate the first roller mechanism and wind the web thereupon. A second motor drivingly engages with the second roller mechanism to rotate the second roller mechanism and wind the web thereupon. A first brake mechanism is provided for the first motor and a second brake mechanism is provided for the second motor.

10 Claims, 4 Drawing Sheets

SCROLLING DISPLAY DEVICE

BACKGROUND OF THE INVENTION

1. Field of the Invention

The present invention is directed to a remotely controlled scrolling sign display device in which opposed rollers may scroll a web containing numbers, letters, or other indicia for display.

2. Prior Art

Remotely controlled scrolling sign display systems which utilize opposed rollers to roll a web are known.

The present invention is directed to a display system that may be used with highway signs that are visible by motorists at great distances. Certain elements of the display will be changed frequently, such as the price of fuel. It is advantageous for such systems to be remotely controlled for a number of reasons. Initially, they are not easily accessible because of the great height of the signs. Further, there is a risk of injury to personnel that work in the high, dangerous location. Also, the display system is not easily accessible in inclement weather.

The present system is often utilized with displays wherein each numeral or letter may range from 2 to 15 feet in height. It can be appreciated that the web containing the numerals 0 through 9, for example, will be of great length. The total radius (including the web) of one roller will, therefore, differ significantly from the other roller, particularly as the web nears each end.

As can be appreciated, the larger the display, the longer the web and, accordingly, the greater the difference in radius between the rollers. When the display is relatively small, the difference in radius of the rollers will not be that significant. The rollers could be designed to operate at the same speed without adverse impact. When the radius of one roller differs significantly from the other roller, the rollers will operate at different rotational speeds with respect to each other. If they did not, the web may sag between the rollers or, alternatively, be prone to tear.

An additional problem presented is the need for a brake mechanism so that one or both rollers do not overrun.

A patentability search has been conducted and the following references were uncovered.

| U.S. Pat. No. | PATENTEE | ISSUE DATE |
|---|---|---|
| 4,741,118 | Aiken et al. | May 3, 1988 |
| 4,680,883 | Stadjuhar et al. | July 21, 1987 |
| 3,726,031 | Singer | April 10, 1973 |
| 4,773,176 | Grehan | September 27, 1988 |
| 4,110,925 | Strand et al. | September 5, 1978 |
| 4,707,938 | Carssow | November 24, 1987 |
| 4,173,087 | Saylor et al. | November 6, 1979 |
| 3,631,618 | Habuka | January 4, 1972 |
| 3,334,432 | Bates et al. | August 8, 1967 |
| 2,935,806 | Young | May 10, 1960 |

Aiken (U.S. Pat. No. 4,741,118) discloses a scrolling mechanism having a single motor rotating in a single direction. A gear box connects a motor shaft to web rolls. The web rolls are coupled to a shaft by selectively engageable clutches, each of which includes a low voltage field coil. When energized, the clutch engages the shaft. With constant braking action provided by spring clips on the web rolls, the motor must continually work against the braking action.

Stadjuhar (U.S. Pat. No. 4,680,883) provides a pair of rollers moving a flexible message web. A tensioning system consists of a freely floating pulley that is connected to a biasing spring in order t accommodate the difference in radii between the rollers.

In Singer (U.S. Pat. No. 3,726,031), a pair of rollers is provided, each with a chain and sprocket connected to a reversible motor. Brackets or strips to which the rollers are mounted, are interconnected by a link which is driven by a reversible motor so that their horizontal alignment may be adjusted.

Grehan (U.S. Pat. No. 4,773,176) shows a scrolling mechanism including an infa-red ray detecting system. A driving mechanism includes a rotary shaft motor connected to sprockets which, in turn, are attached to rollers. A spiral spring within a sprocket, with a minimum tension at its middle point, compensates for the variation in diameter of the rollers.

Strand et al. (U.S. Pat. No. 4,110,925) depicts a scrolling mechanism which includes a drive roll and a take up roll connected to an endless sprocket chain driven by a reversible motor. The different rotational velocities due to different roll diameters are addressed through a helical torsion spring that is wound within the take-up roll. When the diameter of the drive roll is larger than the take-up roll, the spring causes the take-up roll to rotate faster than the drive roll.

Carssow (U.S. Pat. No. 4,707,938) provides two motors, one for each roller, which move a web or flexible panel. One motor runs while the other motor is off and provides a certain resistance. A coil compression spring around each roller abuts the frame and keeps the roller from rotating freely.

Saylor et al. (U.S. Pat. No. 4,173,087) provides a series of adjacent, parallel rollers. A helical spring is intermediate to each roller and its drive gear. Habuka (U.S. Pat. No. 3,631,618), Bates et al. (U.S. Pat. No. 3,334,432), and Young (U.S. Pat. No. 2,935,806) show other display devices.

Accordingly, it is a principal object of the present invention to provide a scrolling display device having opposed rollers with a web that may be scrolled upward to reveal elements wound around the lower roller, scrolled downward to reveal elements wound around the upper roller and tensioned to accommodate any sagging in the web.

It is an additional object and purpose of the present invention to provide a sign scrolling display device that would accommodate different speeds of the rollers as they operate while maintaining the web in a taut position.

It is a further object and purpose of the present invention to provide a braking mechanism for a scrolling sign display device that will retain the web in a taut position yet allow the drive motor to operate without undue strain.

SUMMARY OF THE INVENTION

An upper roller is opposed to and parallel to a lower roller. One end of a web is attached to the upper roller while the opposite end of the web is attached to the lower roller. One end of the upper roller is drivingly connected to the drive shaft of a single direction drive motor. One end of the lower roller is drivingly connected to the drive shaft of a single direction drive motor.

Each motor has an accompanying spring set brake which is mounted on an extension of each motor drive shaft. Each shaft is restrained from turning by the application of a brake shoe or shoes which are held in contact with the drive shaft by force of a compression coil spring. When electric current is applied to the motor, an electric switch is energized so that the brake shoe is released and the shaft may rotate freely.

When a drive shaft is rotated in its opposite direction, the motor acts as a generator to generate voltage. When a certain voltage is reached, a switch activated by the voltage generated will partially release the spring set brake to allow the web to be unrolled more easily.

The system is controlled by a remotely located switch system. The web may be scrolled upward, the web may be scrolled downward, and the web may be tensioned to eliminate any sagging in the web between the rollers.

DETAILED DESCRIPTION OF THE PREFERRED EMBODIMENTS

Figure 1:
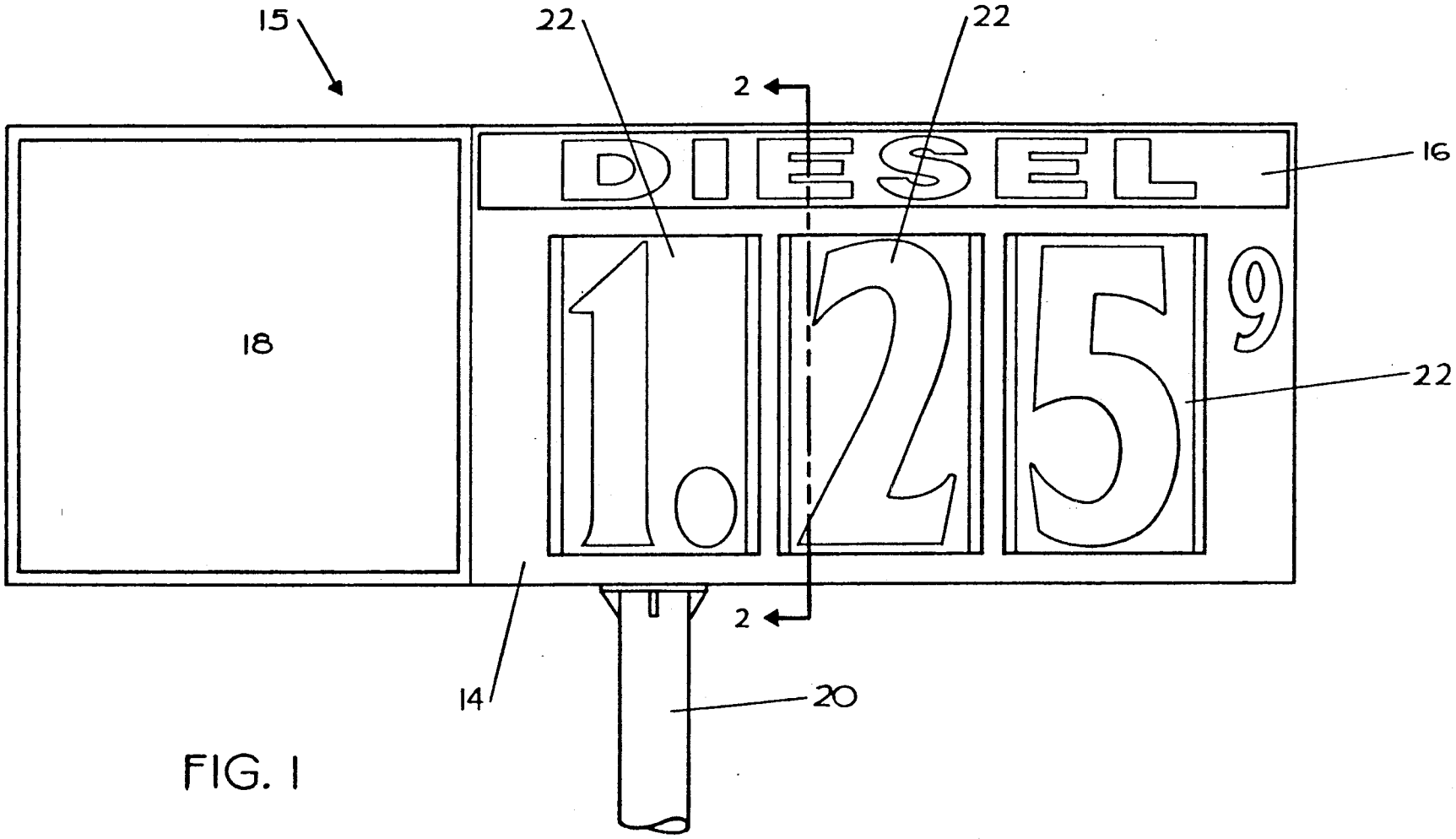
FIG. 1 is a front elevation view of a scrolling display device constructed in accordance with the present invention.

Referring to the drawings in detail, FIG. 1 illustrates one use of the present scrolling display device 10, with highway signs visible at great distances by motorists.

In the embodiments shown, three display devices are visible in FIG. 1. A similar number of devices may be utilized on the opposite side so that the system is visible to traffic from both directions. It should be appreciated that a greater or lesser number of devices may be incorporated therein.

Figure 2:
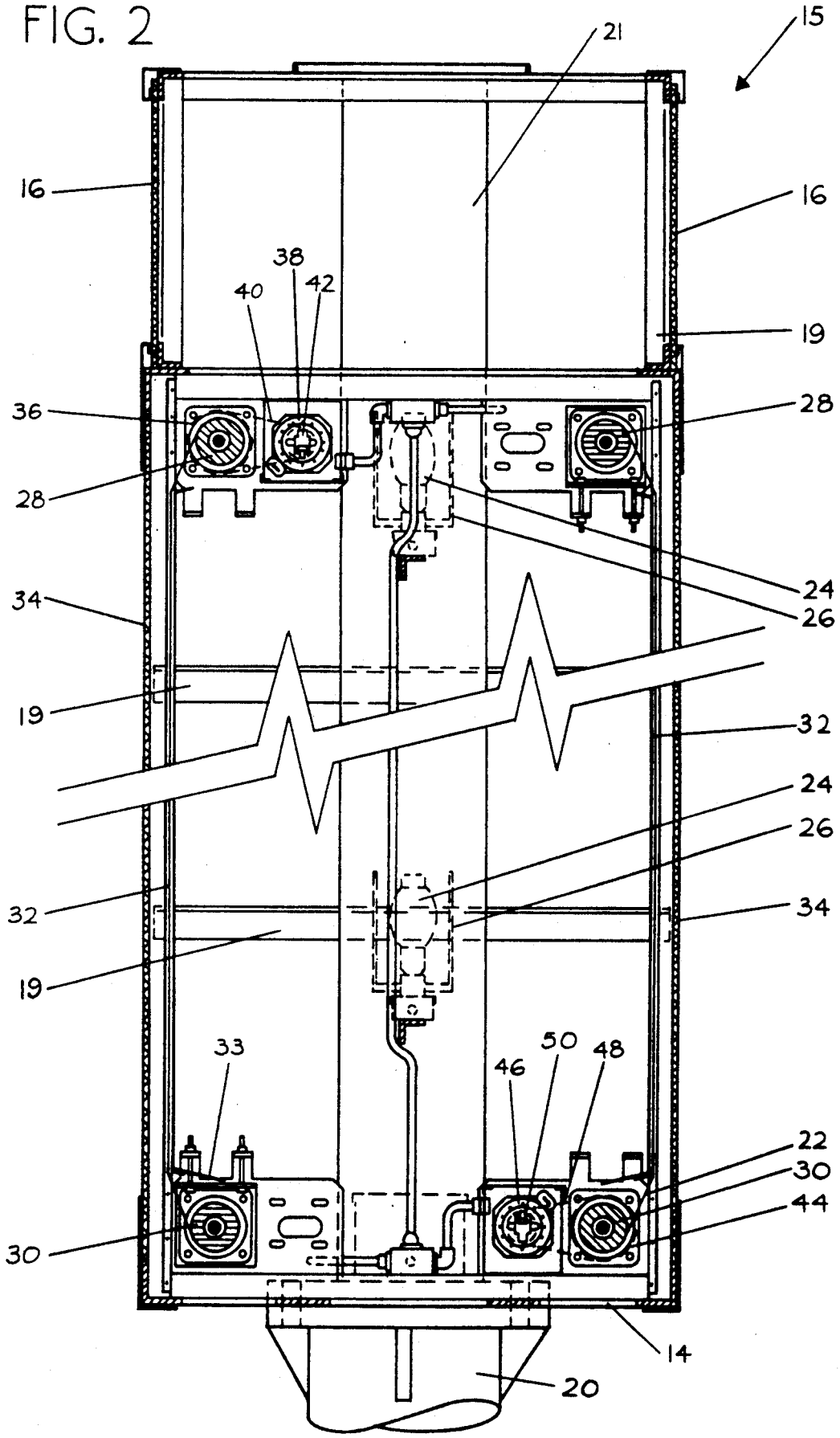
FIG. 2 is a sectional view of the scrolling display device shown in FIG. 1.
Figure 3:
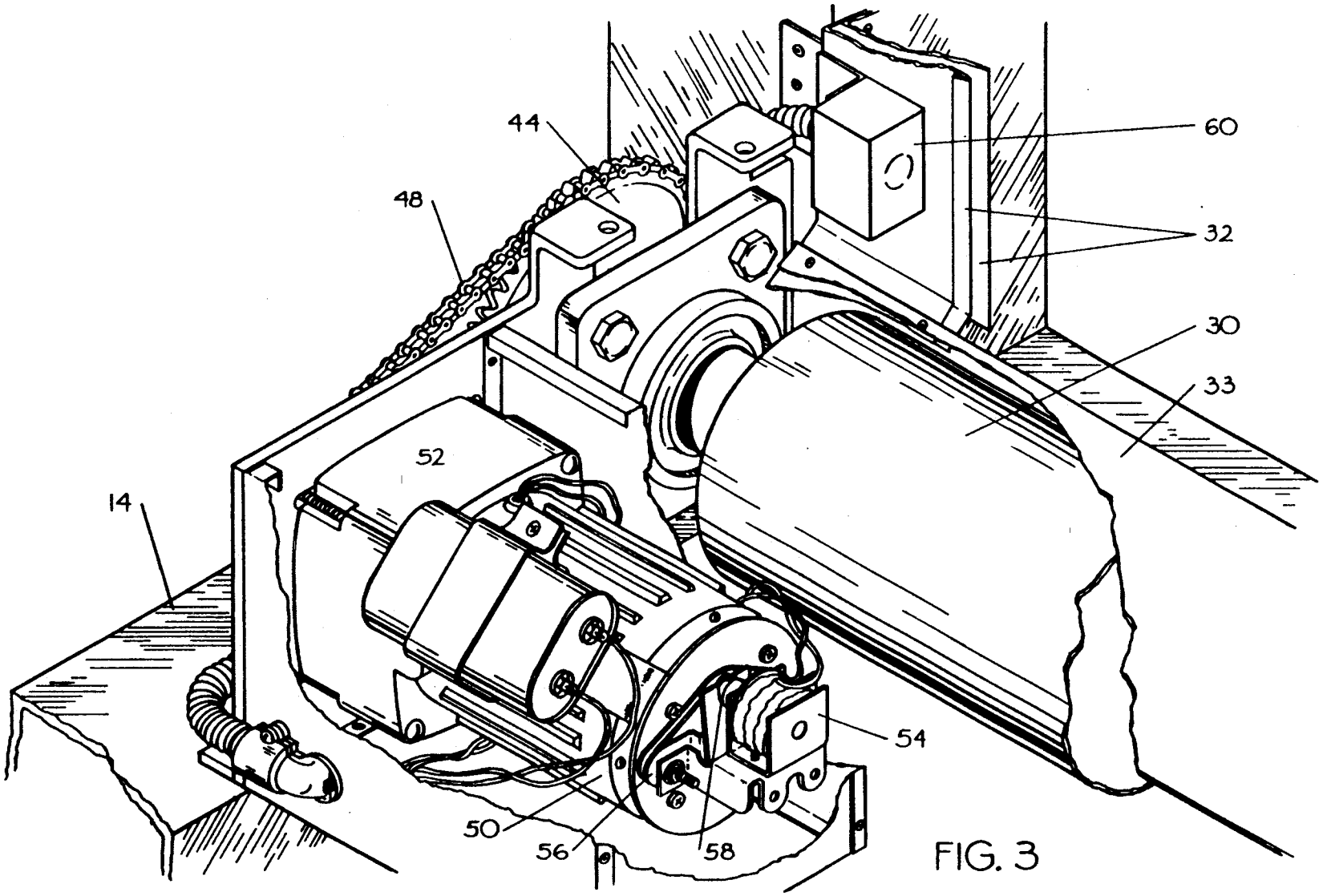
FIG. 3 is a perspective view of a brake mechanism and a motor which form a part of the scrolling display device shown in FIG. 1.

With reference to FIGS. 1 and 2, the device includes a frame 14 to support the system 15 having a top face 16 that may be used to display a product name as well as a side face 18 that may be used to display a brand or merchant name. The frame 14 may be constructed of a sturdy material, such as steel or aluminum, and may include angle irons 19 to provide additional support. The system will be supported from the ground by a post or posts 20 (shown cut-away). The frame may also include interior upright supports or pylons 21 to aid in support.

The elements to be displayed, such as numerals, are screen printed on a thin, flexible material, such as Mylar comprising a web 22 which may be scrolled upward or downward to reveal other numerals. It is advantageous to select a material that will not stretch or tear easily.

It is frequently necessary to change the numerals indicating the price of fuel. As will be described herein, the device may be remotely controlled by an operator.

FIG. 2 depicts a sectional view of the system 15. The frame 14 is arranged with an open interior so that light source 24 with accompanying diffusers 26 illuminate the interior. The numerals on the web 22, as well as the top face 16 and side face 18, are translucent so that they are back lighted. Accordingly, they are visible from great distances, even at night.

Two display devices 10 are seen in FIG. 2 and the description herein of one device applies to both. An upper roller 28 is opposed to and parallel to a lower roller 30. The radii of the rollers has been chosen so that a small number of revolutions is required to wind the web.

One end of the web 22 is attached to the upper roller 28 while the opposite end of the web is attached to the lower roller 30. This arrangement permits the web to wind around one roller while unwinding from the other roller. In the present embodiment, the web contains the numbers 0 through 9. Between the rollers, the web is allowed to move between guide rails 32 arranged so that the web is easily visible from outside. The guide rails also serve to prevent light from leaking out between the edges of the web and the frame 14. An interior blade 33 located near the web will prevent debris such as insects or dirt from accumulating in the lower roller.

The frame 14 supports outer transparent walls 34, composed of Lexan (TM) or other high impact material, so that the web is visible yet protected from the elements. At one end of the upper roller 28, a sprocket 36 is drivingly connected to an upper motor sprocket 38 by a continuous chain 40. The upper motor sprocket 38 is connected to the drive shaft (not seen in FIG. 2) of a single direction drive AC motor 42.

The lower roller 30 is configured similarly to the upper roller and receives the opposite end of the web. At one end of the lower roller 30, a sprocket 44 is driven by a lower motor sprocket 46 connected thereto by a continuous chain 48. The lower motor sprocket is connected to the drive shaft of a single direction drive AC motor 50. Each motor has an accompanying gearbox 52 that reduces the rotational velocity of its driveshaft to approximately 50 rpm.

The device 10 provides for three separate movements. The web 22 may be scrolled upward to reveal one of the numbers wound around the lower roller 30. The web may be scrolled downward to reveal one of the numbers wound around the upper roller 28. Additionally, the web may be tensioned to eliminate any sagging in the web between the rollers; The upper roller is rotated at a slow speed while the lower roller is held in place.

Each motor, 42 and 50, has an accompanying spring set brake 54, best seen in FIG. 5, which is mounted on an extension of each motor drive shaft. Each drive shaft is restrained from turning by the application of a brake shoe or shoes 56 which are held in contact with the drive shaft by force of a compression coil spring moving a plunger 58. The brake shoe is normally in contact with the drive shaft. Thus, when the motor is off, the brake is in the on position. When electric current is applied to one of the motors, an electric coil used as a switch is energized so that the brake shoe is released and the shaft will rotate freely. Thus, when the motor is on, its brake is in the off position.

It will also be appreciated that apart from the brake 54 just described, the gearbox 52 of each motor provides some braking.

Cutting the current off from the motor de-energizes the switch and the spring and plunger 58 immediately cause the brake shoe 56 to grip the drive shaft in order to stop the roller from moving.

At the same time that one of the motors is rotating its drive shaft in the drive direction, the opposite motor will have its shaft turning in the direction opposite of the drive direction. For instance, when the upper motor 42 is rotating the upper roller 28 in the drive direction, the web is winding onto the upper roller 28. The lower roller 30 will then be rotating in the direction opposite its drive direction. This will cause the drive shaft on the lower motor 50 to rotate in the direction opposite the drive direction. The lower motor 50 then acts as a generator to generate voltage when its shaft rotates in the opposite direction. When a certain voltage is reached, the coil switch activated by the voltage generated will partially release the spring set brake 54 on the lower motor 50 to allow the web to be unrolled more easily. In the present embodiment, the lower roller 30 will be rotated a few revolutions before the brake is partially released. In operation, when the upper motor 42 is activated, it will initially rotate the roller and pull the web against the brake set on the lower motor 50. After the web has moved a certain amount, the lower brake will be partially released to allow the web to be unrolled more easily.

In can be appreciated that a similar operation will occur when the lower motor is scrolling the web downward. When the lower motor 50 is rotating the lower roller 30 in the drive direction, the web is winding onto the lower roller 30. The upper roller 28 will then be rotating in the direction opposite its drive direction. This will cause the drive shaft on the upper motor to rotate in the direction opposite its drive direction. The upper motor 42 then acts as a generator to generate voltage.

A limit mechanism 60 is also provided to prevent the web from winding beyond its ends. Near each end, a hole is provided in the web. A spring-loaded button switch mounted on the frame rests against the web. When the web nears its end, the button will mate with the hole and extend therethrough. The button switch is wired to the motor with the web rolled thereon. Extension of the button switch deactivates the motor.

Figure 4:
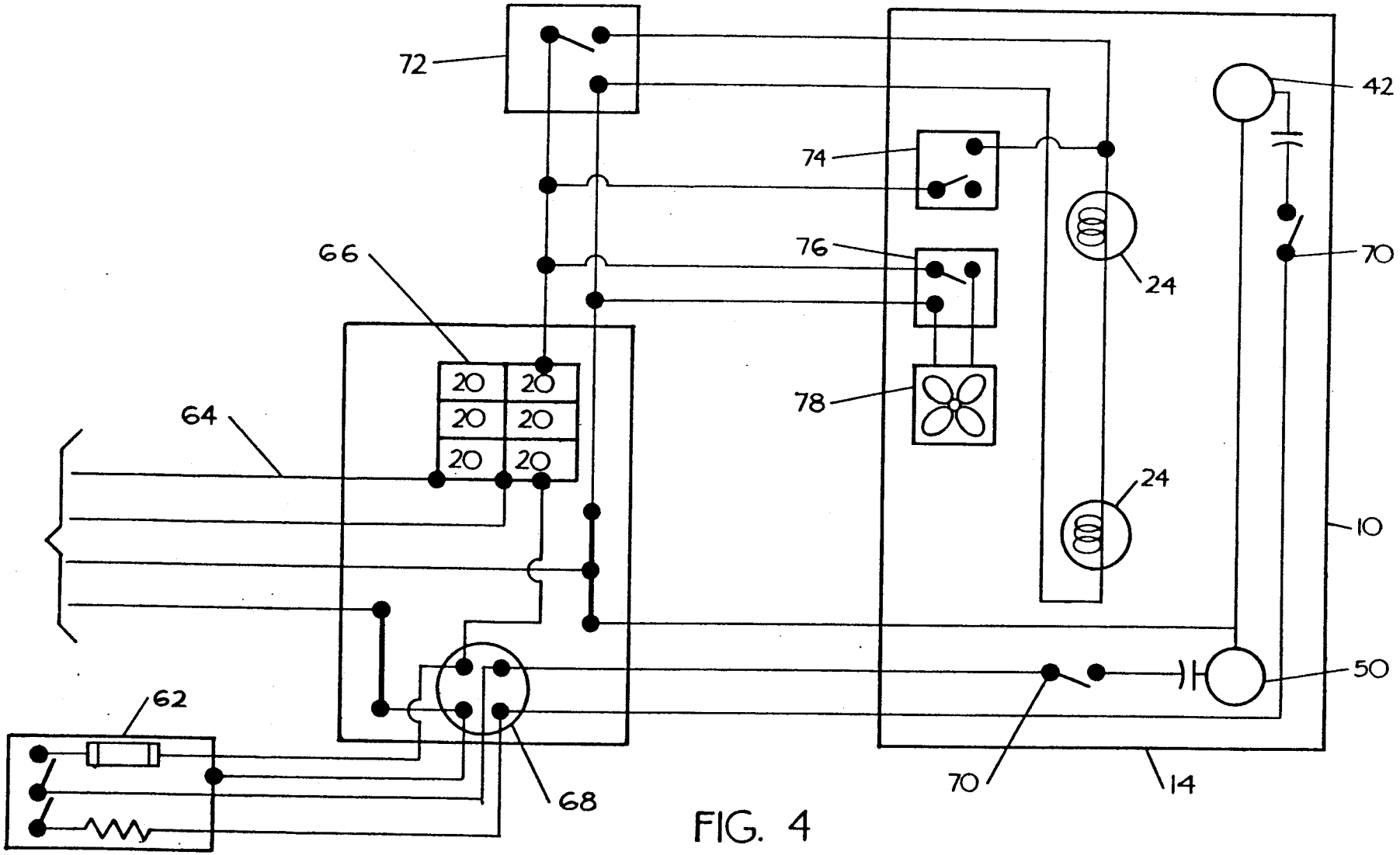
FIG. 4 is a block and schematic diagram of the scrolling display device shown in FIG. 1.

FIG. 4 shows a schematic, block diagram of the device. The system 15 is controlled by a remotely located control system 62. A double pole switch has one side which activates the upper roller motor in its drive direction while the other side operates the lower roller motor in its drive direction. An additional switch or button operates to tension the rollers against each other. When the tension switch is activated, the lower motor 50 remains in the off position so that the brake is engaged. At the same time, the upper motor 42 is activated at reduced voltage. The upper motor 42 will rotate the upper roller 28 to eliminate any sagging in the web but will not overpower the brake on the drive shaft of the lower motor 50. Thus, the web will be moved into a taut position and stop.

Electric power for the device may be provided by electrical service 64 passing through circuit breakers 66. The control system may take the form of a hand held device that may be plugged into the base of the system 15 through plug 68 or may be configured to be radio controlled. The limit mechanisms 70, previously described, are illustrated by switches.

A timer switch 72 may also be incorporated into the system so that the light source 24 will be illuminated at night. Upper and lower switches 74 and 76 may be combined with a thermometer to help control the temperature inside the frame 14. When the temperature falls below a predetermined temperature, switch 74 will activate light source 24 which will give off heat. When the temperature rises above a predetermined temperature, switch 74 will activate fan 78 to ventilate the device.

Whereas the present invention has been described in relation to the drawings attached hereto, it should be understood that other and further modifications, apart from those shown or suggested herein, may be made within the spirit and scope of this invention.

What is claimed is:

1. A scrolling display device which comprises:

a. first roller means and second roller means opposed and parallel to each other;

b. a web display extending between said first and second roller means;

c. first motor means including a rotatable drive shaft drivingly engaged with said first roller means in order to rotate said first roller means and wind a portion of said web thereupon, said first motor means rotatably driving said drive shaft in a single direction only, said drive shaft being free to overrun in the opposite direction;

d. second motor means including a rotatable drive shaft drivingly engaged with second roller means in order to rotate said second roller means and wind a portion of said web thereupon;

e. first brake means for said first motor means including brake shoes in contact with said rotatable drive shaft when said first motor means is off, said brake means being released when said drive shaft rotates in said drive direction;

f. second brake means for said second motor means including brake shoes in contact with said rotatable drive shaft when said second motor means is off; and g. control and switch means for said first motor means and said second motor means so that said first motor means may be engaged to rotate said web upon said first roller means, or alternatively, said second motor means may be engaged to rotate said web upon said second roller means.

2. A scrolling display device as set forth in claim 1 wherein said first motor means is an electric motor and operates to generate voltage when its drive shaft is rotated in said opposite direction and including switch means to partially release said first brake means in response to a predetermined voltage generated.

3. A scrolling display device as set forth in claim 1 wherein said control and switch means may activate said first motor means at reduced power while said second brake means holds said second roller means in place in order to eliminate any slack in said web.

4. A scrolling display device as set forth in claim 1 wherein said control and switch means is remotely located.

5. A scrolling display device which comprises:

a. first roller means and second roller means opposed and parallel to each other;

b. a web display extending between said first and second roller means;

c. first motor means including a rotatable drive shaft drivingly engaged with said first roller means in order to rotate said first roller means and wind a portion of said web thereupon;

d. second motor means including a rotatable drive shaft drivingly engaged with second roller means in order to rotate said second roller means and wind a portion of said web thereupon, said second motor means rotatably driving said drive shaft in a single direction only, said drive shaft being free to overrun in the opposite direction;

e. first brake means for said first motor means including brake shoes in contact with said rotatable drive shaft when said first motor means is off;

f. second brake means for said second motor means including brake shoes in contact with said rotatable drive shaft when said second motor means is off, said brake means being released when said drive shaft rotates in said drive direction; and g. control and switch means for said first motor means and said second motor means so that said first motor means may be engaged to rotate said web upon said first roller means, or alternatively, said second motor means may be engaged to rotate said web upon said second roller means.

6. A scrolling display device as set forth in claim 5 including a frame and lighting means within said frame and wherein said web display includes transparent or translucent elements so that said elements will be lighted.

7. A scrolling display device as set forth in claim 5 wherein said second motor means is an electric motor and operates to generate voltage when its drive shaft is rotated in said opposite direction and including switch means to partially release said second brake means in response to a predetermined voltage generated.

8. A scrolling display device which comprises:

a. first roller means and second roller means opposed and parallel to each other;

b. a web display extending between said first and second roller means;

c. first motor means including a rotatable drive shaft drivingly engaged with said first roller means in order to rotate said first roller means and wind a portion of said web thereupon, said first motor means rotatably driving said drive shaft in a single direction only, said drive shaft being free to overrun in the opposite direction;

d. second motor means including a rotatable drive shaft drivingly engaged with second roller means in order to rotate said second roller means and wind a portion of said web thereupon;

e. first brake means for said first motor means including brake shoes in contact with said rotatable drive shaft when said first motor means is off, said brake means being released when said drive shaft rotates in said drive direction;

f. second brake means for said second motor means including brake shoes in contact with said rotatable drive shaft when said second motor means is off; and g. control and switch means having at least three positions, a first position wherein said motor means may be engaged to rotate said web upon said first roller means, a second position wherein said second motor means may be engaged to rotate said web upon said second roller means, and a third position wherein both said first and said second motor means are off.

9. A scrolling display device which comprises:

a. first roller means and second roller means opposed and parallel to each other;

b. a web display extending between said first and second roller means;

c. first motor means including a rotatable drive shaft drivingly engaged with said first roller means in order to rotate said first roller means and wind a portion of said web thereupon;

d. second motor means including a rotatable drive shaft drivingly engaged with second roller means in order to rotate said second roller means and wind a portion of said web thereupon, said second motor means rotatably driving said drive shaft in a single direction only, said drive shaft being free to overrun in the opposite direction;

e. first brake means for said first motor means including brake shoes in contact with said rotatable drive shaft when said first motor means is off;

f. second brake means for said second motor means including brake shoes in contact with said rotatable drive shaft when said second motor means is off, said brake means being released when said drive shaft rotates in said drive direction; and g. control and switch means having at least three positions, a first position wherein said motor means may be engaged to rotate said web upon said first roller means, a second position wherein said second motor means may be engaged to rotate said web upon said second roller means, and a third position wherein both said first and said second motor means are off.

10. A scrolling display device as set forth in claim 1 including a frame and lighting means within said frame and wherein said web display includes transparent or translucent elements so that said elements will be lighted.

* * * * *